United States Patent [19]

Sarno

[11] Patent Number: 5,000,446

[45] Date of Patent: Mar. 19, 1991

[54] COLOR-CODED WEIGHT STACK PIN SYSTEM FOR EXERCISE MACHINES

[76] Inventor: Timothy N. Sarno, 1815 ½-10th St., Santa Monica, Calif. 90404

[21] Appl. No.: 588,408

[22] Filed: Sep. 26, 1990

[51] Int. Cl.[5] ..... A63B 21/062; A63B 21/00; A63B 21/06

[52] U.S. Cl. ..... 272/118; 272/117; 272/93

[58] Field of Search ..... 272/116, 117, 118, 93

[56] References Cited

U.S. PATENT DOCUMENTS

| | | | |
|---|---|---|---|
| 571,521 | 11/1896 | Heberline et al. | |
| 791,912 | 6/1905 | Jackson . | |
| 1,810,826 | 6/1931 | Gray . | |
| 2,721,561 | 10/1955 | Dyche . | |
| 3,306,437 | 2/1967 | Nelson . | |
| 3,749,233 | 7/1973 | McCormick . | |
| 3,815,904 | 6/1974 | Weiss et al. | 272/136 |
| 3,878,939 | 4/1975 | Wilcox . | |
| 4,155,446 | 5/1979 | Aronson . | |
| 4,195,059 | 3/1980 | Witcher et al. | |
| 4,411,426 | 10/1983 | McCoy et al. | 272/126 |
| 4,624,642 | 11/1986 | Ferrara | |
| 4,815,610 | 3/1989 | Borick et al. | |
| 4,834,396 | 5/1989 | Schnell | 272/117 |

*Primary Examiner*—Richard J. Apley
*Assistant Examiner*—Karen G. Horowitz
*Attorney, Agent, or Firm*—Cislo & Thomas

[57] ABSTRACT

Methods and apparatus are disclosed for insuring the use of the correct weight stack pin in setting the desired weight on a weight loading stack of a weight exercise machine in an installation including different types of machines. The weight stack pin of each type of machine is marked with a particular color specific to that type of machine, a sign plate is affixed to each individual machine bearing indicia including the color code specific to that type of machine and an outline of the shape of the weight stack pin used in that type of machine, and a chart is prominently displayed bearing instructions for correct weight stack pin selection and including a list of all the color and pin-shape indicia from all of the different types of weight exercise machines in an exercise facility. Apparatus in kit form comprises means for marking each weight stack pin with the proper color, a sign plate for each machine bearing the proper color and an outline of the proper weight stack pin, means for affixing each plate to an individual machine of the appropriate type, and a display chart as described above for prominent display at a central location in the exercise facility where the chart can be easily seen and read by users of the weight exercise machines.

25 Claims, 3 Drawing Sheets

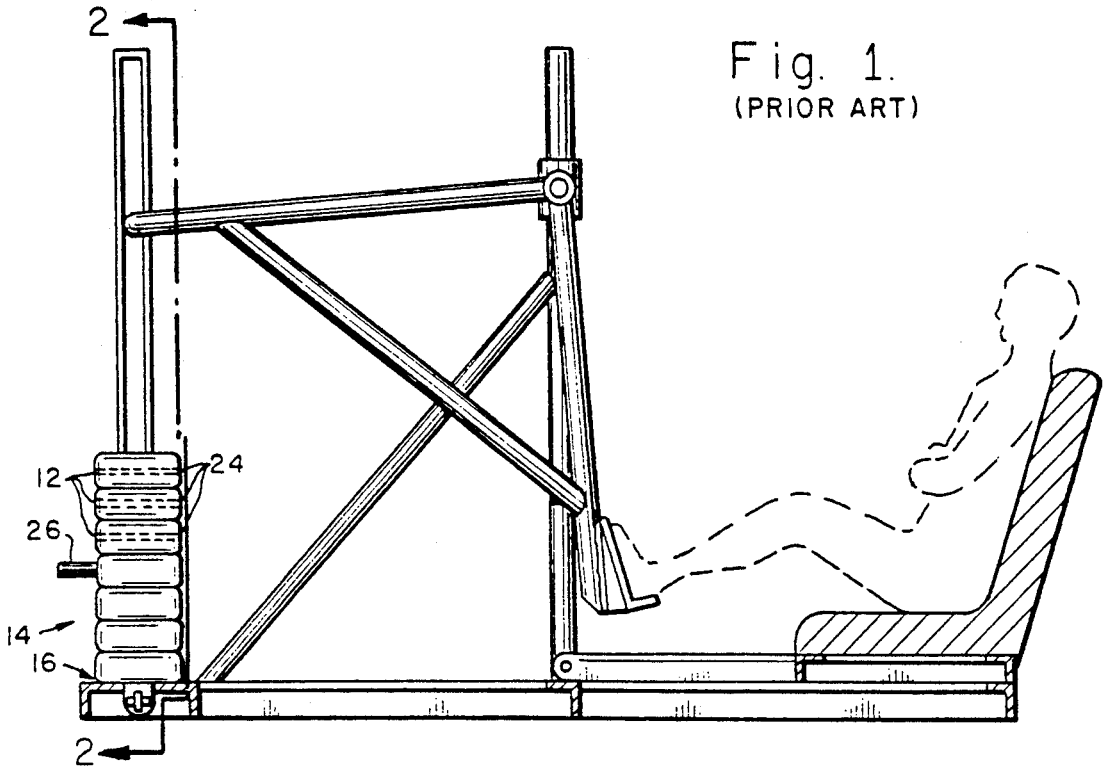
Fig. 1.
(PRIOR ART)
Fig. 2.
(PRIOR ART)
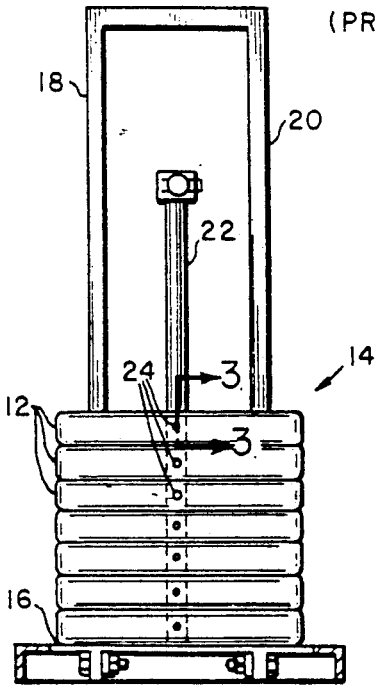
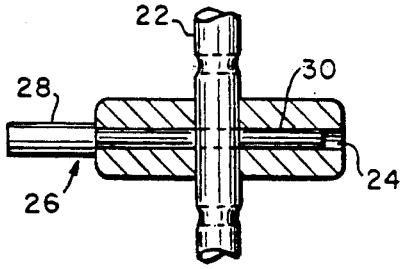
Fig. 3.
(PRIOR ART)

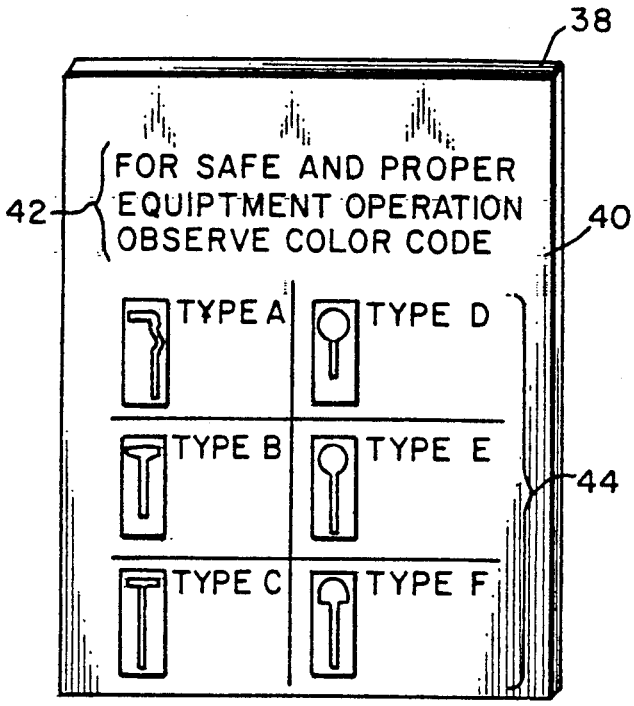
Fig. 10.
Fig. 11.
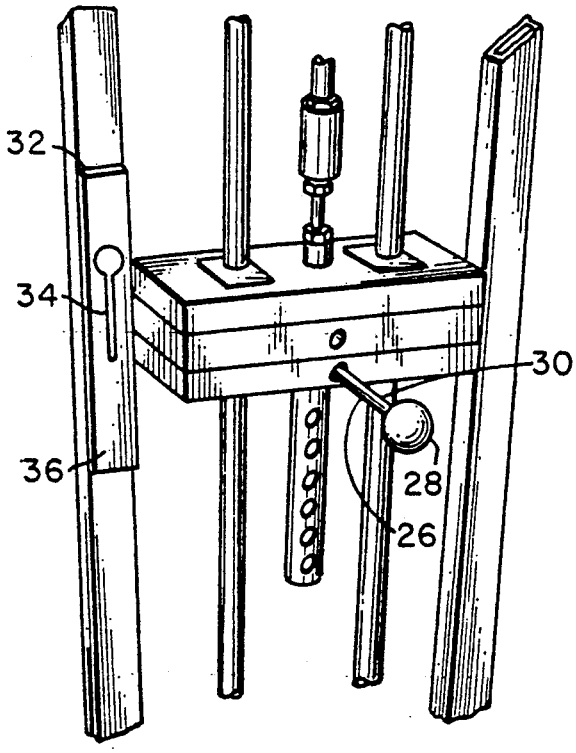

COLOR-CODED WEIGHT STACK PIN SYSTEM FOR EXERCISE MACHINES

BACKGROUND OF THE INVENTION

This invention relates to methods and apparatus for facilitating the safe use of weight exercise machines. In particular, the invention is directed to methods and apparatus for insuring the use of the correct weight stack pin in setting the desired weight on a weight loading stack of a weight exercise machine in an installation including different types of machines.

With the realization of the importance of regular exercise in the maintenance of physical health has come an increased use of exercise machines utilizing adjustable stacks of weights. Typically, various different muscle groups of the user are exercised on different machines. Generally, all of the machines employ in one form or another a stack of weights which can be engaged in varying amounts by changing the location where a pin is inserted in the stack of individual weights.

There are a variety of different machines manufactured and sold, with different types of weight stack pins having different diameters and lengths and designs. It is possible to use the wrong pin in a given type of machine when there is more than one kind of machine present in an installation. The result of using the incorrect weight stack pin in a weight exercise machine is at best an unsafe operating condition and at worst an accident producing personal injury.

The present invention is in response to a long felt need for a safety system that will prevent the use of the wrong type of weight stack pin in any given type of weight exercise machine.

Accordingly, it is an object of the present invention to provide methods and apparatus for facilitating the use of the correct weight stack pin in setting the weight to be lifted on any particular machine in an exercise facility making use of different types of exercise machines with different weight stack pin arrangements.

Another object of the present invention is to provide a method and apparatus for insuring the use of the correct weight stack pin in any particular weight exercise machine by making use of both color coding and pin shape indicia.

A further object of the present invention is to provide a given type of weight stack pin having a particular shape with a given color associating that type of pin with its corresponding exercise machine.

Yet another object of the present invention is to provide a given type of weight exercise machine with a plate bearing both pin-shape and color indicia corresponding to the shape of the proper pin and the color of its head portion.

Another object of the present invention is to provide a pin selection safety kit for an exercise facility comprising a plurality of applicator-type containers each containing a different color paint and a plurality of identification plates each bearing color and pin-shape indicia corresponding to a particular type of weight exercise machine, and means of affixing the identification plates to their respective machines at locations prominently visible to the user of the machine.

Still another object of the invention is to provide a pin selection safety kit further comprising a chart for prominent display in an exercise facility, bearing instructions for correct weight pin selection and including a list of all the color and pin-shape indicia from all of the different types of weight exercise machines in the facility.

Finally, it is an object of the present invention to provide a method of selecting the correct weight stack pin for a particular exercise machine in a facility including more than one type of machine comprising (1) marking each weight stack pin of each type of machine with a particular color, (2) affixing to each weight exercise machine a plate bearing indicia including the color specific to that type of machine and an outline of the shape of the weight stack pin for that machine, and (3) prominently displaying in the facility a chart with instructions for correct pin selection and further including a list of all the colors and shapes of the pins for the different types of machines used in the facility.

SUMMARY OF THE INVENTION

Methods and apparatus are disclosed for facilitating the use of the correct weight stack pin in setting the desired weight on a weight loading stack of an individual weight exercise machine in an installation including a plurality of different types of weight exercise machines. The weight stack pin of each type of machine is marked with a particular color specific to that type of machine, a sign plate is affixed to each individual machine bearing indicia including the color code specific to that type of machine and an outline of the shape of the weight stack pin used in that type of machine, and a chart is prominently displayed bearing instructions for correct weight stack pin selection and including a list of all the color and pin-shape indicia from all of the different types of weight exercise machines in an exercise facility.

Apparatus in kit form for modifying an installation of a plurality of different types of weight exercise machines to facilitate the use of the correct weight stack pin in setting the desired weight on a weight loading stack of any individual machine comprises means for marking each weight stack pin with the proper color, a sign plate for each machine bearing the proper color and an outline of the proper weight stack pin, means for affixing each plate to an individual machine of the appropriate type, and a display chart as described above for prominent display at a central location in the exercise facility where the chart can be easily seen and read by users of the weight exercise machines.

BRIEF DESCRIPTION OF THE DRAWINGS

FIG. 1 is a side elevational view of a prior-art weight exercise machine including a weiqht stack with weight stack pin for selecting the amount of weight to be lifted in exercising;

FIG. 2 is a partially fragmented front view of the weight stack of the machine shown in FIG. 1;

FIG. 3 is a fragmented sectional view as indicated in FIG. 2 of the weight stack pin inserted into an individual weight and through the movable rod;

FIG. 10 is a perspective view of a display chart bearing instructions for correct weight pin selection and including a list of all the color and pin-shape indicia from all of the different types of weight exercise machines in the exercise facility; and FIG. 11 is a partially fragmented perspective view of the weight stack and surrounding structural portions of a weight exercise machine showing a color-coded weight stack pin and a sign plate installed.

DETAILED DESCRIPTION OF THE INVENTION

Figure 4:
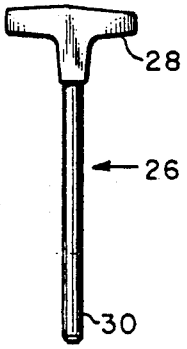
FIG. 4 is a perspective view of a first type of weight stack pin used in a first type of weight exercise machine.

FIG. 1 depicts a prior-art exercising machine to show the general nature of the weight stack arrangement which is typical of many such machines. A plurality of individual weights 12 in a weight stack 14 rest on a base 16. Referring to FIG. 2, each individual weight 12 has three vertical holes therethrough. The holes at each end of an individual weight 12 accommodate upstanding vertical structural members 18 and 20 of the frame of the machine. The central hole in each individual weight 12 accommodates a vertically movable rod 22 having a series of spaced-apart transverse horizontal holes in a distal end thereof which line up with a corresponding series of transverse holes 24 in the individual weight 12, with one transverse hole 24 for each individual weight 12.

Referring to FIG. 3, a weight stack pin 26 can be inserted through one of the transverse holes 24 in an individual weight 12 and further into the corresponding transverse hole in the movable rod 22, so that when movable rod 22 is lifted by the lever mechanism of the machine, only the individual weight 12 through which the pin 26 has been inserted and those weights 12 above the weight containing the pin are lifted along with movable rod 22. Weight stack pin 26 comprises a head portion 28 and a body portion 30 which fits into one of the holes 24 to allow insertion of pin 26 into one of the spaced-apart holes in the movable rod 22, as shown in FIG. 3.

Figure 5:
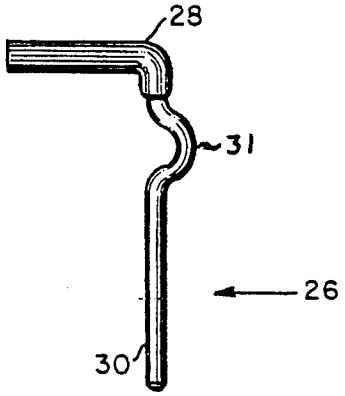
FIG. 5 is a perspective view of a second type of weight stack pin used in a second type of weight exercise machine.
Figure 6:
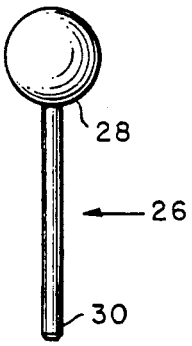
FIG. 6 is a perspective view of a third type of weight stack pin used in a third type of weight exercise machine.

FIGS. 4–6 show three different types of weight stack pins used in typical weight exercise machines. In each case the weight stack pin comprises a head or handle portion 28 and a body portion 30. The weight stack pin shown in FIG. 4 has a generally T-shaped head portion 28. The weight stack pin shown in FIG. 5 has a straight head portion 28 generally at right angles to the body portion 30; in addition, there is a kink 31 in the shape of the body portion 30 near head portion 28. The weight stack pin shown in FIG. 6 has a generally spherical head portion 28 and a straight body portion 30.

Of crucial importance from the standpoint of safety is the length and diameter of the body portion 30 for a particular weight stack pin 26. If the length of the body portion 30 is insufficient or body portion 30 has the wrong diameter for the weight stack arrangement with which someone attempts to use it, the pin 26 may not fully engage the movable rod 22 and individual weight 12 into which it is inserted. If one attempts to use a particular weight exercise machine with the wrong weight stack pin, the weights intended to be lifted in exercising may disengage from the movable rod 22 and fall through the distance through which they have been lifted, possible damaging the exercise machine, injuring the user, or both.

The present invention provides a method for facilitating the use of the correct weight stack pin 26 in setting the desired weight load on a weight loading stack of an individual weight exercise machine in an installation including a plurality of different types of such machines. The method comprises (1) marking each weight stack pin 26 of each type of machine with a particular color specific to that type of machine and (2) attaching or affixing to each individual machine a plate or sign bearing indicia including the color specific to that type of machine and an outline of the shape of the weight stack pin used in that type of machine.

Figure 7:
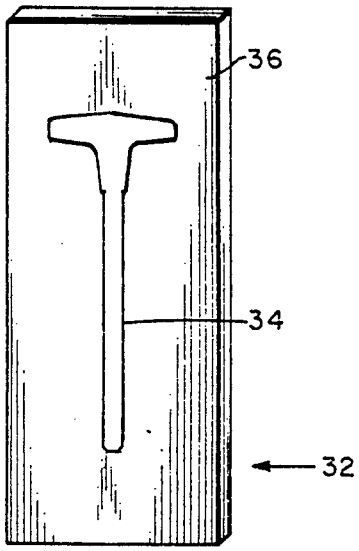
FIG. 7 is a perspective view of a sign plate bearing color and shape indcia for the weight stack pin shown in FIG. 3.
Figure 8:
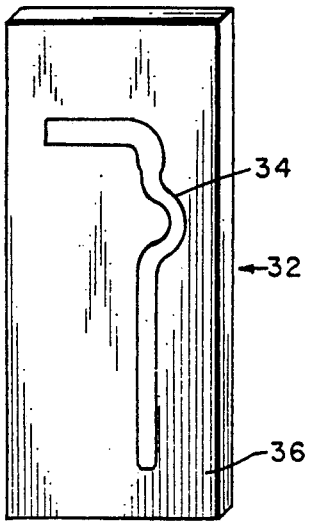
FIG. 8 is a perspective view of a sign plate bearing color and shape indicia for the weight stack pin shown in FIG. 5.
Figure 9:
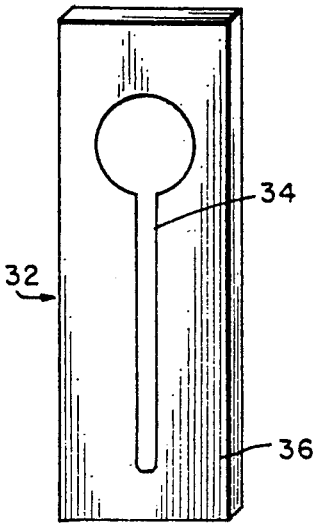
FIG. 9 is a perspective view of a sign plate bearing color and shape indicia for the weight stack pin shown in FIG. 6.

FIGS. 7–9 depict plates 32 for each of the types of weight stack pins shown in FIGS. 4–6, respectively. The plate 32, which can be constructed of plastic, wood, or heavy cardboard, bears an outline 34 of the appropriate weight stack pin 26 and a color background 36 having the same color as the color marking on the head 28 of the pin 26 used in the type of machine to which plate 32 is to be affixed. Thus, for example, the background 36 of the plate in FIG. 7 might be red, the background 36 of plate 32 in FIG. 8 might be green, and the background 36 of plate 32 in FIG. 9 might be blue.

According to the method of the invention, each individual weight exercise machine in an exercising facility would have a proper identifying plate 32 fastened to some part of the machine where it would be visible to a person selecting the proper weight for an exercise session. A convenient and simple way of attaching the plate 32 to an exercise machine would be by means of an adhesive. Alternatively, the plate 32 could be fastened to a portion of the structure of the weight exercise machine by metal screws through holes drilled in the plate 32 and into the frame of the machine.

The method of the invention can comprise the additional step of permanently displaying in the exercise facility a chart bearing instructions for correct weight stack pin selection and including a list of all the color and pin-shape indicia from all of the different types of weight exercise machines in the exercise facility. FIG. 10 depicts such a chart including a backing 38 and a face portion 40 comprising brief written instructions 42 and a list 44 of colors and pin shapes next to the names of the different types of weight exercise machines used in the facility.

The first step of marking different types of weight stack pins 26 with different colors can be accomplished in various ways. The head portion 28 of each weight stack pin 26 might be painted with the appropriate color or coated with a plastic material having the appropriate color.

Alternatively, the pin 26 could be replaced with a substitute pin having the identical size and shape as the original but having a colored head portion 28 of the appropriate color. Thus, for example, an all-metal weight stack pin 26 might be replaced with a weight stack pin having a body portion 30 with a threaded end screwed into a colored head portion 28 made of an unbreakable or impact-resistant plastic material.

In accordance with the invention, apparatus is provided for modifying a plurality of weight exercise machines in an exercising facility including different types of such machines. Use of the apparatus, which may take the form of a kit, facilitates the use of the correct weight stack pin in setting the desired weight on the weight loading stack of an individual machine. The apparatus comprises a means for marking each weight stack pin 26 of each type of machine with a particular color specific to that type of machine, a plurality of identification plates each bearing indicia including the color specific to that type of machine and an outline of the shape of the weight stack pin used in that type of machine, and means for affixing each identification plate to an individual machine of the appropriate type. A convenient kit form could provide a sufficient number of marking means of different colors, pin identification plates, and affixing means to adequately service an average-sized facility of exercise machines. The kit could optionally include a chart bearing instructions for correct weight stack pin selection, including a list of all the color and pin-shape indicia from all of the different types of weight exercise machines in the installation, as shown in FIG. 10.

The means for marking weight stack pins might comprise a plurality of cans of different-colored spray paint, with a different color spray paint for each type of weight exercise machine. Other possibilities for the marking means would be a plurality of paint or lacquer containers containing different colored paints or lacquers and each having a brush-type applicator top for conveniently marking the head portion 28 of each weight stack pin 26, or a plurality of containers of different colored liquid plastic materials that form a hard coating when applied.

FIG. 11 shows a weight exercise machine modified in accordance with the present invention. The head portion 28 of the weight stack pin 26 has been marked with a color specific to that type of machine. An identification plate 32 has been affixed to the frame of the exercise machine at a location where it is prominently visible to the user of the machine when the amount of weight to be lifted is chosen. Identification plate 32 bears an outline of the shape of the pin 26 on a background of the same color as that of the head 28 of the weight stack pin 26.

Obviously, numerous variations and modifications can be made to the methods and apparatus described above without departing from the present invention. For example, the pin identification plates meant to be affixed to each machine could take a variety of forms, so long as the particular color associated with that type of pin is displayed and the shape of the pin indicated in some manner. Similarly, a variety of means for affixing or attaching the pin identification plates to the exercise machines are well known in the art. Also, since part of the general population suffers from "color blindness," it would be a simple expedient to add a one-letter indicia to a pin or pin identification plate to denote the color of the pin or plate for a color-blind person. Thus, the letter "R" could be used to indicate a pin or plate bearing a red color, the letter "G" to indicate a green color, and so on. It should be understood that the form of the present invention described above and shown in the figures is illustrative only and is not intended to limit the scope of the present invention.

What is claimed is:

1. A method for facilitating the use of the correct weight stack pin in setting the desired weight on a weight loading stack of an individual weight exercise machine in an installation including a plurality of different types of weight exercise machines each having a related weight stack pin of distinct shape and size, comprising:

marking each weight stack pin of each type of machine with a particular color specific to that type of machine; and affixing to each individual machine a plate bearing indicia including the color specific to that type of machine and an outline of the shape of the weight stack pin used in that type of machine;

whereby a user of said machines will be aided in using the correctly shaped and sized weight stack pin in setting the desired weight on the weight loading stack of any individual machine and thereby avoid unsafe operating conditions or accidents associated with using the wrong type of weight stack pin in any particular individual weight exercise machine.

2. The method of claim 1 wherein in said affixing step each said plate is affixed to each said machine at a location prominently visible to a user of said machine when said user is adjusting the weight on the weight stack of said machine.

3. The method of claim 1 wherein in said marking step each said weight stack pin has a head portion which is marked with said specific color associated with that type of weight exercise machine.

4. The method of claim 3 wherein each said weight stack pin includes a head portion and a body portion and said marking step comprises painting the head portion of each said weight stack pin with paint of said specific color associated with that type of machine.

5. The method of claim 3 wherein said marking comprises coating the head portion of each said weight stack pin with a plastic material having said specific color associated with that type of machine.

6. The method of claim 1 wherein each said plate comprises an outline in white of the shape of said weight stack pin surrounded by a solid background of said specific color.

7. The method of claim 1 comprising the additional step of displaying a chart in said installation bearing instructions for correct weight stack pin selection, including a list of all the color and pin-shape indicia from all of the different types of weight exercise machines in said installation.

8. The method of claim 7 wherein in said affixing step each said plate is affixed to each said machine at a location prominently visible to a user of said machine when said user is adjusting the weight on the weight stack of said machine.

9. The method of claim 7 wherein each said weight stack pin includes a head portion and a body portion and in said marking step said head portion is marked with said specific color associated with that type of weight exercise machine.

10. The method of claim 9 wherein said marking step comprises painting said head portion of each said weight stack pin with paint of said specific color associated with that type of machine.

11. The method of claim 9 wherein said marking step comprises coating the head of each said weight stack pin with a plastic material having said specific color associated with that type of machine.

12. The method of claim 7 wherein each said plate comprises an outline in white of the shape of said weight stack pin surrounded by a solid background of said specific color.

13. A method for facilitating the use of the correct weight stack pin in setting the desired weight on a weight loading stack of an individual weight exercise machine in an installation including a plurality of different types of weight exercise machines each having a related weight stack pin of distinct shape and size, comprising:

replacing each weight stack pin of each type of machine with an identically shaped weight stack pin marked with a particular color specific to that type of machine; and affixing to each individual machine a plate bearing indicia including the oolor specific to that type of machine and an outline of the shape of the weight stack pin used in that type of machine;

whereby a user of said machines will be aided in using the correctly shaped and sized weight stack pin in setting the desired weight on the weight loading stack of any individual machine and thereby avoid unsafe operating conditions or accidents associated with using the wrong type of weight stack pin in any particular individual weight exercise machine.

14. Apparatus for modifying an installation of a plurality of different types of weight exercise machines each having a related weight stack pin of distinct shape and size to facilitate the use of the correct weight stack pin in setting the desired weight on a weight loading stack of an individual weight exercise machine comprising:

means for marking each weight stack pin of each type of machine with a particular color specific to that type of machine;

a plurality of plates, each said plate bearing indicia including the color specific to that type of machine and an outline of the shape of the weight stack pin used in that type of machine; and means for affixing each said plate to an individual machine of the appropriate type;

whereby a user of said machines will be aided in using the correctly shaped and sized weight stack pin in setting the desired weight on the weight loading stack of any individual machine and thereby avoid unsafe operating conditions or accidents associated with using the wrong type of weight stack pin in any particular individual weight exercise machine.

15. The apparatus of claim 14 wherein said means for affixing comprises an adhesive material and each said plate is intended to be affixed with said material to each said machine at a location prominently visible to a user of said machine when said user is adjusting the weight on the weight stack of said machine.

16. The apparatus of claim 14 wherein said means for marking comprises a plurality of containers of paint of different colors, with each color associated with a specific type of weight machine, and a means for painting the head of each said weight stack pin with said paint of a color associated with that type of machine.

17. The apparatus of claim 14 wherein said means for marking comprises a plurality of containers of spray paint of different colors, with eaoh color associated with a specific type of weight machine.

18. The apparatus of claim 14 wherein each said weight stack pin includes a head portion and a body portion and wherein said means for marking comprises means for coating said head portion of each said weight stack pin with a plastic material having a specific color associated with that type of machine.

19. The apparatus of claim 14 wherein each of said plurality of plates comprises an outline in white of the shape of said weight stack pin surrounded by a solid background of said specific color.

20. The apparatus of claim 14 further comprising a chart intended to be prominently displayed in said installation, bearing instructions for correct weight pin selection, including a list of all the color and pin-shape indicia from all of the different types of weight exercise machines in said installation.

21. The apparatus of claim 20 wherein said means for affixing comprises an adhesive material and each said plate is intended to be affixed with said material to each said machine at a location prominently visible to a user of said machine when said user is adjusting the weight on the weight stack of said machine.

22. The apparatus of claim 20 wherein each said weight stack pin has a head portion and a body portion, said body portion being inserted into said weight stack in use, and wherein said means for marking comprises a container of paint of said specific color and a means for painting the head portion of each said weiqht stack pin with said paint of said specific color associated with that type of machine.

23. The apparatus of claim 20 wherein said marking means comprises means for ooatinq the head portion of each said weight stack pin with a plastic material having said specific color associated with that type of machine.

24. The apparatus of claim 20 wherein each of said plurality of plates comprises an outline in white of the shape of said weight stack pin surrounded by a solid background of said specific color.

25. Apparatus for modifying an installation of a plurality of different types of weight exercise machines each having a related weight stack pin of distinct shape and size to facilitate the use of the correct weight stack pin in setting the desired weight on a weight loading stack of an individual weight exercise machine, comprising:

a plurality of replacement weight stack pins, each said replacement pin being marked with a particular color associated with the type of weight exercise machine whose weight stack pin said replacement pin is intended to replace;

a plurality of plates, each said plate bearing indicia including the color specific to that type of machine and an outline of the shape of the weight stack pin used in that type of machine; and means for affixing each said plate to an individual machine of the appropriate type;

whereby a user of said machines will be aided in using the correctly shaped and sized weight stack pin in setting the desired weight on the weight loading stack of any individual machine and thereby avoid unsafe operating conditions or accidents associated with using the wrong type of weight stack pin in any particular individual weight exercise machine.

* * * * *